US006442935B1

(12) United States Patent
Larsen

(10) Patent No.: US 6,442,935 B1
(45) Date of Patent: Sep. 3, 2002

(54) DRIVING SYSTEM FOR MACHINERY, SUCH AS A MOTOR, COMPRESSOR ETC.

(75) Inventor: Thor Larsen, Fyllingsdalen (NO)

(73) Assignee: 3D International A/S, Bergen (NO)

( * ) Notice: Subject to any disclaimer, the term of this patent is extended or adjusted under 35 U.S.C. 154(b) by 0 days.

(21) Appl. No.: 09/762,792

(22) PCT Filed: Jul. 30, 1999

(86) PCT No.: PCT/NO99/00245

§ 371 (c)(1),
(2), (4) Date: Apr. 13, 2001

(87) PCT Pub. No.: WO00/09860

PCT Pub. Date: Feb. 24, 2000

(30) Foreign Application Priority Data

Aug. 14, 1998 (NO) ..... 983728

(51) Int. Cl.[7] ..... F01B 29/10

(52) U.S. Cl. ..... 60/519; 60/518; 123/241; 418/51; 418/68

(58) Field of Search ..... 60/518, 519; 418/51, 418/52, 53, 68, 49; 123/241

(56) References Cited

U.S. PATENT DOCUMENTS

| | | | | | |
|---|---|---|---|---|---|
| 1,434,741 | A | | 11/1922 | Goodner | 418/51 |
| 2,173,663 | A | * | 9/1939 | Raumond | 123/241 |
| 2,814,935 | A | * | 12/1957 | Sigworth | 60/519 |
| 3,816,039 | A | * | 6/1974 | Berry | 418/68 |
| 3,877,850 | A | | 4/1975 | Berry | 418/68 |
| 4,441,869 | A | * | 4/1984 | Larsen et al. | 418/51 |
| 4,938,025 | A | | 7/1990 | Larsen | 418/53 |
| 5,127,810 | A | * | 7/1992 | Kolbinger | 418/68 |
| 5,147,193 | A | | 9/1992 | Larsen | 418/68 |
| 5,171,142 | A | | 12/1992 | Proglyada | 418/68 |
| 6,241,493 | B1 | * | 6/2001 | Turner | 418/68 |

FOREIGN PATENT DOCUMENTS

| | | |
|---|---|---|
| DE | 466916 | 10/1928 |
| DE | 43 28 223 A1 | 3/1995 |

* cited by examiner

*Primary Examiner*—Thomas Denion
*Assistant Examiner*—Thai-Ba Trieu
(74) *Attorney, Agent, or Firm*—Shanks & Herbert

(57) ABSTRACT

A driving system (13) comprises a housing (10) having spherical hollow space (11), a rotatable main shaft (14), a driving means (16) and a piston construction (15). The piston construction (15) is rockable about a first rocking axis (15*a*) in a rectilinear motion backwards and forwards relative to a stationary wall portion (12). The driving means (16) is pivotally mounted in the main shaft (14) about a pivotable axis (16*b*) which forms an acute angle with the rotatable axis (14*a*) of the main shaft (14) and is rockably mounted in the piston construction (15) about a second rocking axis (16*a*), which extends at right angles to the first rocking axis (15*a*). The first and second rocking axis (15*a*, 16*a*) cross the rotational axis (14*a*) of the main shaft (14) at a common crossing point (11*c*) centrally in the spherical hollow space (11).

4 Claims, 16 Drawing Sheets

DRIVING SYSTEM FOR MACHINERY, SUCH AS A MOTOR, COMPRESSOR ETC.

TECHNICAL FIELD

The present invention relates to a driving system which is designed for use in various types of machines, such as combustion engines, pumps, compressors and the like.

BACKGROUND OF THE INVENTION

The driving system according to the invention comprises a housing having a spherical hollow space, a rotatable main shaft, a driving means drivingly connected to the main shaft and a piston construction connected to the driving means, where the the piston construction is rockable backwards and forwards in the hollow space relative to a stationary wall portion in the hollow space and where one end of the driving means which participates in the rotary motion of the main shaft, is pivotally mounted in the main shaft about a pivotal axis which forms an acute angle with the axis of rotation of the main shaft.

Various driving systems of the afore-mentioned kind are known. There are employed a housing with a spherical hollow space, a rotatable main shaft and one or more pistons which are moved backwards and forwards in a forced rocking motion in the spherical hollow space, where the piston/pistons constitute a driven or a driving component of the driving system.

In DE 466 916 there are employed a pair of semi-spherical chambers on opposite sides of a stationary, first partition plate, which extends radially, that is to say across the rotational axis of the driving system centrally in the spherical hollow space. A rigid main shaft part passes through the spherical hollow space and is rotatably mounted via opposite, mutually aligned shaft pins at opposite ends of the housing. The shaft pins carry their respective laterally displaced, globular cup-shaped transition portion having an intermediate centre pin (driving means), which extends obliquely of the rotational axis of the main shaft. The centre pin is rotatably mounted internally in a piston construction consisting of a pair of conical pistons. The pistons are subjected to an unrolling motion on opposite sides of such a first, radially extending partition plate in their respective semi-spherical chambers. In each semi-spherical chamber two work chambers are defined by means of a second, axially extending partition plate, which connects conical portions of the pistons to each other and which passes through a slot in the first radially extending partition plate, something which creates special sealing problems in between the partition plates.

In U.S. Pat. No. 4,938,025 a similar system is shown, where the second partition plate is avoided and simultaneously the sealing problems which accompany such a through-passing partition plate are avoided. Instead the first partition plate is rockably mounted about a rocking axis, which extends across the rotational axis of the main shaft.

In both of the of afore-mentioned known solutions, where pistons are employed, which are subjected to combined rocking and pivotal movement, one is dependent upon the pistons being subjected to a seal-forming unrolling movement along the associated (first) partition plate. In practice it is difficult to ensure precise sealing via the pistons, since during use there will necessarily occur significant wear between the partition plate and the pistons, by the very fact that the pistons are rolled directly against the partition plate.

In U.S. Pat. No. 5,147,193 a solution is shown, where said seal-forming unrolling motion is avoided. Instead a sliding sealing abutment is employed between the pistons and the partition plate. The main shaft part comprises a rotatable, axially extending partition plate, instead of the radially extending, that is to say the transversely extending partition plate. Together with the partition plate there is rotatably mounted a piston construction comprising a pair of mutually rigidly connected ball segment-formed, that is to say orange boat-formed pistons. By this solution the combined rockable and pivotable motion of the pistons relative to a locally arranged partition plate is avoided. This is achieved by allowing the partition plate and the pistons to rotate jointly and by allowing in addition the rotatable pistons to be set in a rectilinear rocking motion relative to the rotatable partition wall.

The piston construction during its rotational movement is forced into a rocking motion backwards and forwards relative to the partition plate via a stationary journal and a rotatable control member, which is moveable in an oblique plane relative to the rotational axis of the main shaft. The piston construction is subjected to considerable rocking movement relative to the partition plate and in addition participates in the rotational movement together with the partition wall. It is a significant practical problem that large rotational forces occur centrally in the rotor member via the stationary journal and the associated rotatable control member.

In U.S. Pat. No. 1,434,741 a pump is shown having a rotatable main shaft, which is connected to a disc-shaped piston via a piston rod rigidly connected to the piston, the longitudinal axis of which extends obliquely of the rotational axis of the main shaft. A stationary pump housing is employed having a part-spherical, central hollow space, which spans over an arc angle of about 30° relative to a spherical centre point. The hollow apace is divided by means of a stationary, axially extending partition plate, which passes through the piston via a transversely extending slot in the piston. The partition plate forces the piston into a combined rocking and pivoting movement relative to a conical stop in the surrounding pump housing. Consequently in a corresponding manner as in DE 466 916 one is dependent upon a complicated sealing abutment in a slot between two relatively moveable parts, of which the piston executes a combined sliding and rolling off movement. One end of the piston rod extends at right angles to the disc-shaped piston, while the opposite end of the piston rod, which participates in the rotational movement of the main shaft, is pivotally mounted in a head portion of the main shaft part, eccentrically about the rotational axis of the main shaft. Consequently one is compelled to employ a relatively narrow hollow space in the pump housing in combination with the stationarily arranged partition plate.

With the present invention the aim is a constructionally and operatively favourable solution, which provides a simple piston movement and minimal sealing problems.

As the state of the art in the area is taken the particular starting point of the solution according to U.S. Pat. No. 1,434,741. Inter alia in this connection the aim is to employ a considerably larger spherical hollow space than in the solution according to U.S. Pat. No. 1,434,741 plus avoiding the axially extending partition wall and the sealing problems connected therewith.

SUMMARY OF THE INVENTION

The driving system according to the present invention is characterised in that the piston construction, which comprises a pair of mutually rigidly connected pistons, is rockable relative to the surrounding housing about a first rocking axis, which passes centrally through the spherical hollow space at right angles to the rotational axis of the main shaft, that the piston construction is rockable towards and from an intermediate, stationary wall portion, which projects radially inwardly into a first hollow space section of the spherical hollow space and divides the hollow space section into two opposite work chambers, that the other end of the driving means is rockably mounted in the piston construction about a second rocking axis, which extends at right angles to the first rocking axis, the first and second rocking axes crossing the rotational axis of the main shaft at a common crossing point centrally in the spherical hollow space.

According to the invention three parts moveable relative to each other are employed instead of two parts moveable relative to each other according to the known solution, as shown in U.S. Pat. No. 1,434,741.

In the known two-part solution the piston is subjected to a rolling off movement, that is to say a combined pivoting and, rocking movement, relative to a stationary surface, which extends across the rotational axis of the main shaft, while with the equivalent three-part solution according to the invention the piston construction is subjected to a simple, rectilinear rocking movement, that is to say a pure rocking movement, relative to a stationary, centrally arranged, stop-forming partition wall.

In this connection two rocking axes are employed according to the invention, of which the one is arranged between the piston construction and the surrounding housing and the other between the piston and the main shaft via a separately moveable driving means, instead of the rigid connection between driving means/piston rod and piston in the known solution according to U.S. Pat. No. 1,434,741.

According to the invention the associated pistons of the piston construction are rocked about in a rocking plane, which extends at right angles to the stationary partition wall in the spherical hollow space. By means of the simple, pure rocking movement of the piston construction a relatively simple sealing off of the piston construction is achieved, based on sliding seals between the piston construction and the stationary inner walls of the spherical hollow space. In addition complicating rotational forces are avoided in the piston per se. In that the partition wall free endingly projects axially inwardly towards the piston construction, a simple slide seal can in addition also be employed between the piston construction and the partition wall.

The afore-mentioned simple rocking movement and simple sealing off is ensured by the driving means being rockably mounted in the piston construction on the side of the piston construction which faces away from the stationary partition wall. This means that the work chambers of the first hollow space section are easy to seal of f relative to the stationary partition wall and relative to the piston and the surrounding inner wall of the first hollow space section respectively.

According to the invention provision is made for the work chambers of the first hollow space section to be defined between the rockable piston construction and a stationary housing portion, the stationary partition wall included.

This means that the rocking movement of the piston construction in the first hollow space section can be sealed off in a simple and dependable manner, so that leakage of gas medium can be effectively prevented from the first hollow space section to the second hollow space section or vice-versa. Consequently there is the opportunity to use and design the second hollow space section more or less independently of the first hollow space section.

According to a particular aspect of the present invention the driving system is further characterised in that the pistons of the piston construction constitute the main pistons of the driving system, which form a part of the first hollow apace section, while the driving means constitutes an auxiliary piston, which forms a part of the second hollow space section, the driving means being disc-shaped and dividing the second hollow apace section into two associated auxiliary chambers.

According to the invention the second hollow space section is mainly formed by a rotatable housing part, which is directly connected to the main shaft, the rotatable housing part including a rotary bearing for the associated guide pin of the driving means. By this the driving means can be received in a rotating second hollow space having a backwards and forwards rocking movement relative to the rotatable housing part, so that the driving means can form an auxiliary piston having associated piston movement in the rotatable housing part.

The auxiliary piston can be employed for various auxiliary functions in connection with the main functions of the main pistons, but without being dependent upon the functions of the combustion chambers, as will be evident from the following description.

BRIEF DESCRIPTION OF THE DRAWINGS

In the following there shall be described an embodiment according to the present invention having regard to the accompanying drawings, in which.

DETAILED DESCRIPTION OF THE PREFERRED EMBODIMENTS

Figure 1:
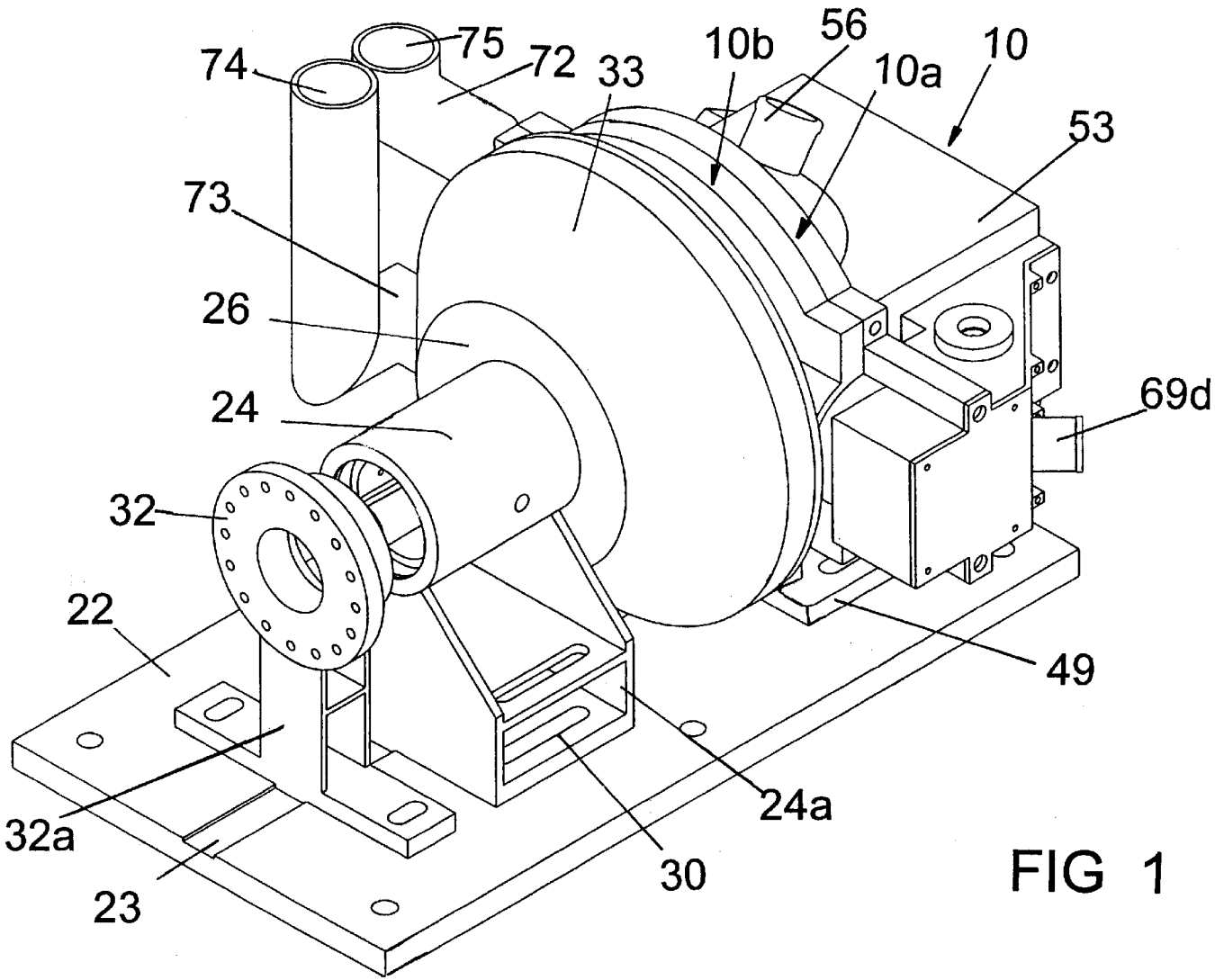
FIGS. 1–4 show the driving system according to the present invention used in connection with a two-stroke combustion engine, illustrated in perspective from opposite ends in FIGS. 1 and 2 and from the side in FIG. 3 plus in horizontal longitudinal section in FIG. 4.
Figure 2:
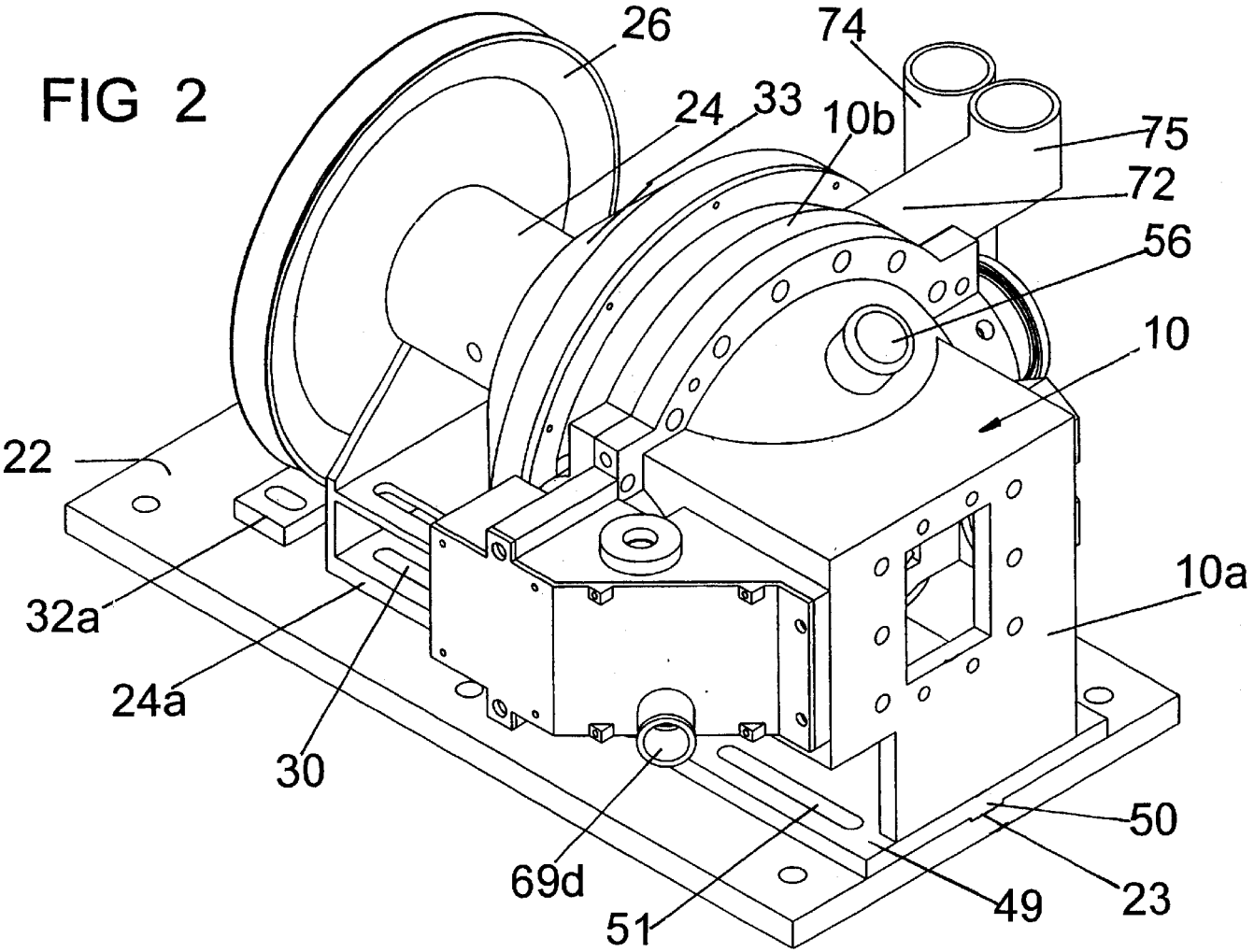
Figure 3:
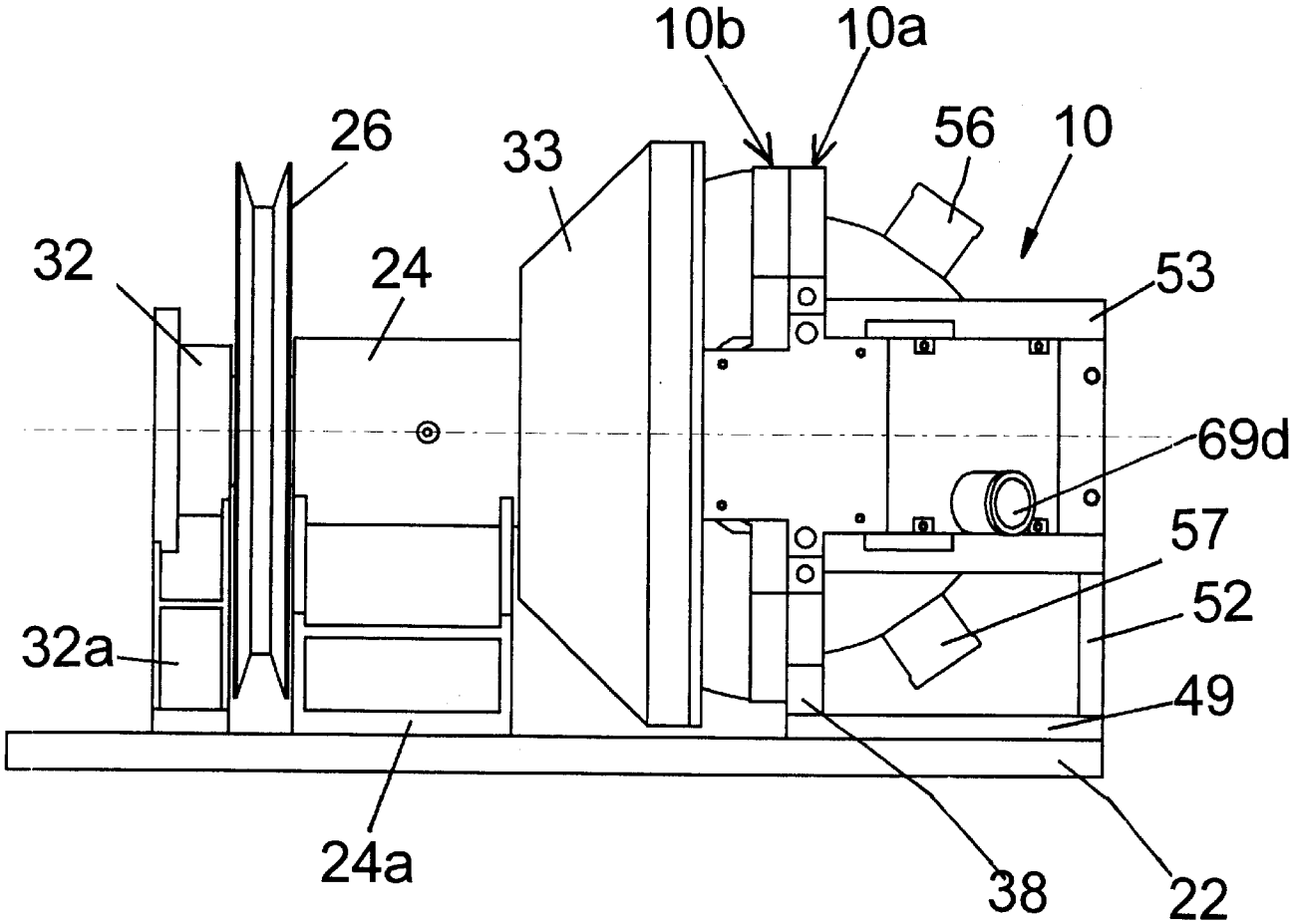
Figure 4:
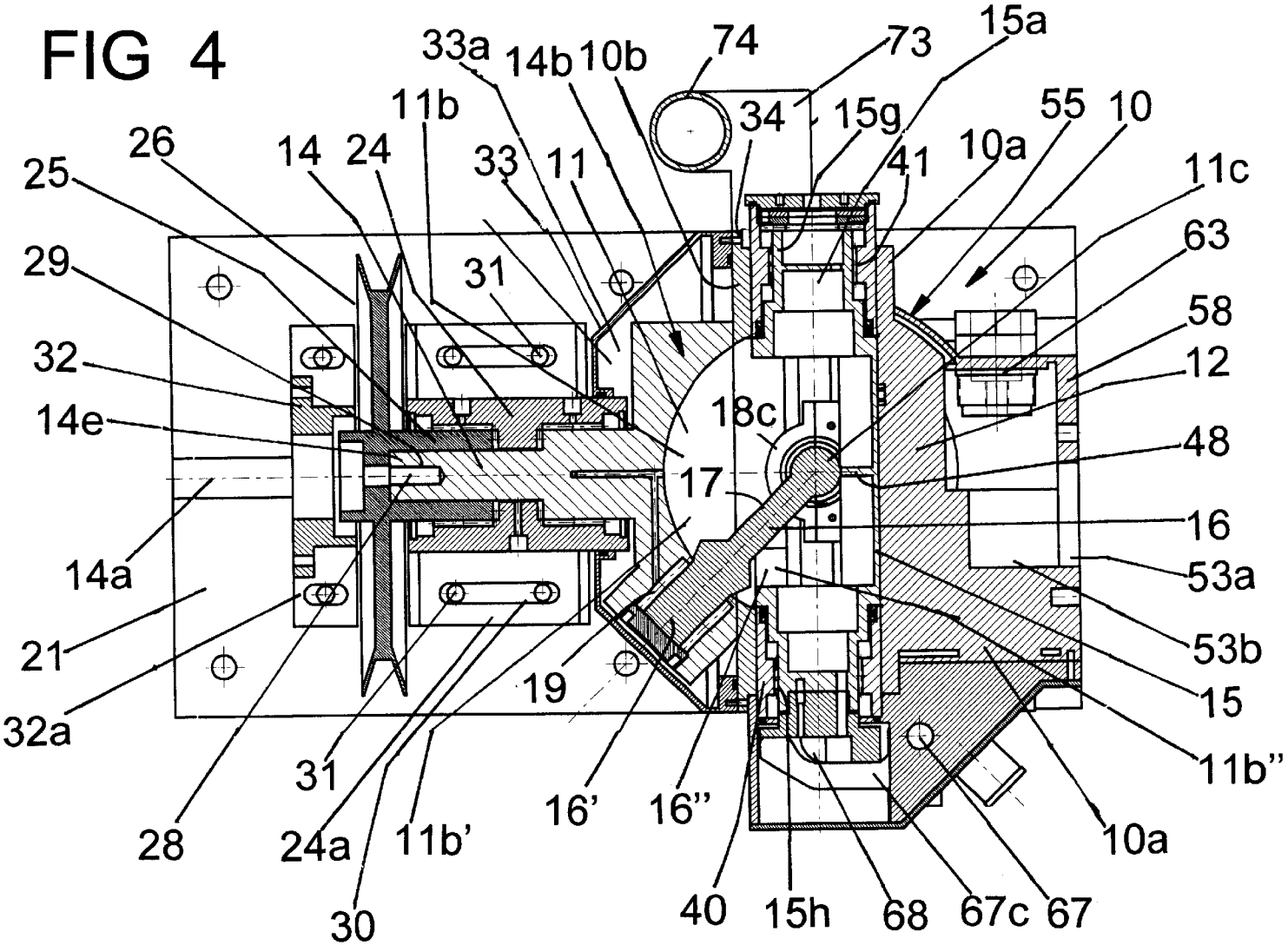
Figure 4A:
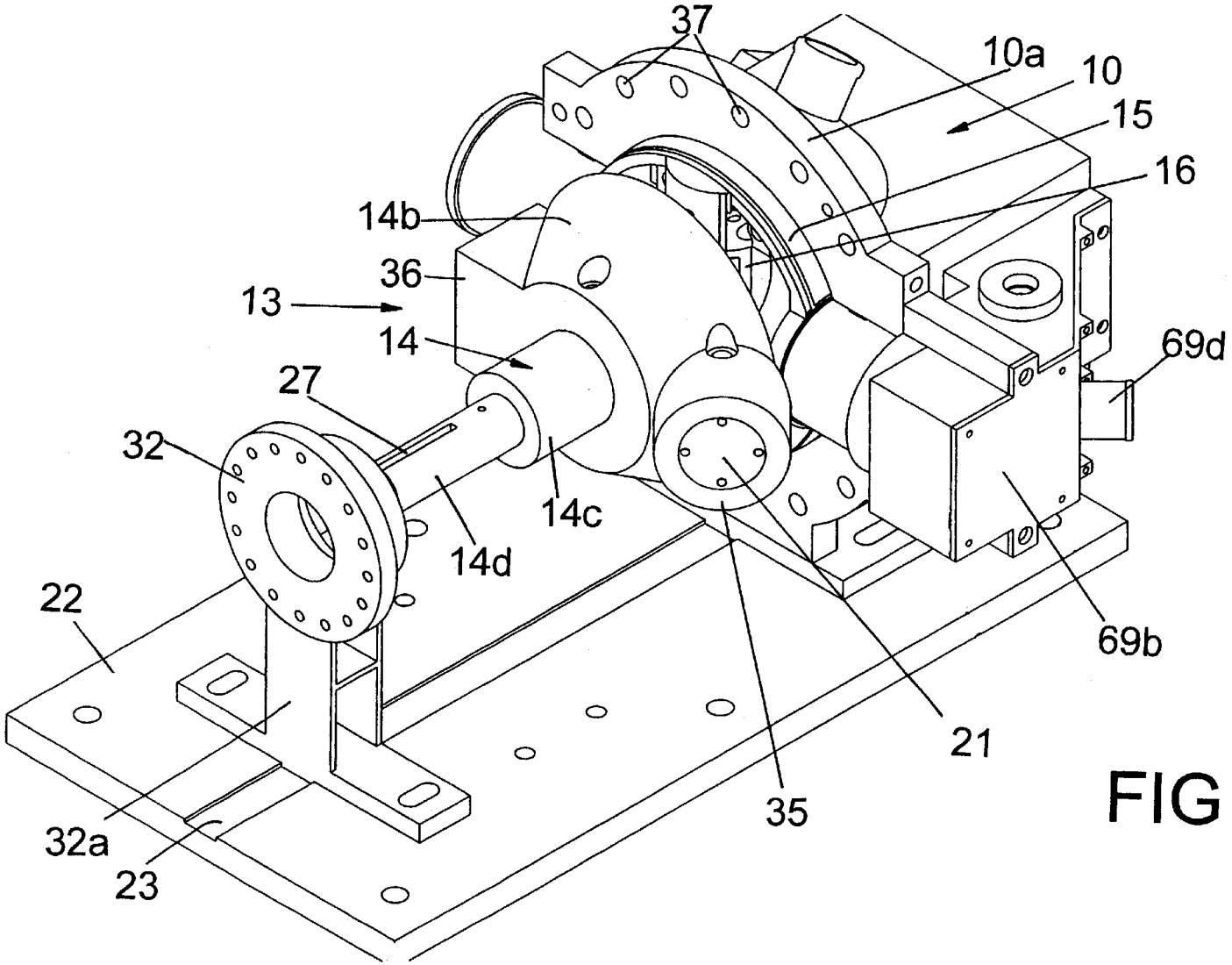
FIG. 4*a* shows in perspective a driving system according to the invention.

The present invention relates to a driving system 13, as is shown in FIG. 4*a*. In an embodiment, as illustrated in FIGS.

1–4, the driving system is shown together with a two-stroke combustion engine. Alternatively the invention can be used together with other types of machines, for example for four-stroke or other types of combustion engines, for compressor, hydraulic pump, hydraulic motor, etc. without particular embodiments thereof being illustrated herein. The driving system 13 constitutes an essential construction which in general can be employed arbitrarily in one of the afore-mentioned engines/machines.

The Driving System According to the Invention

The driving system 13 comprises in general an engine housing 10 and three moveable components 14,15,16, as shown in FIG. 4*a*.

The engine housing 10 is provided with a "cylinder"—forming spherical hollow space 11. (see FIG. 4). The hollow space 11 of the engine housing 10 has projecting radially inwards a partition wall—forming ball segment portion 12 (see FIGS. 4 and 6) which forms a stationary partition wall in the spherical hollow space 11.

The moveable components 14,13,16 are shown separately for the sake of simplicity, that is to say mutually distinct along an axis 14*a* of the driving system 13, as is shown in FIG. 5 and FIGS. 5*a*–5*d*.

Figure 5:
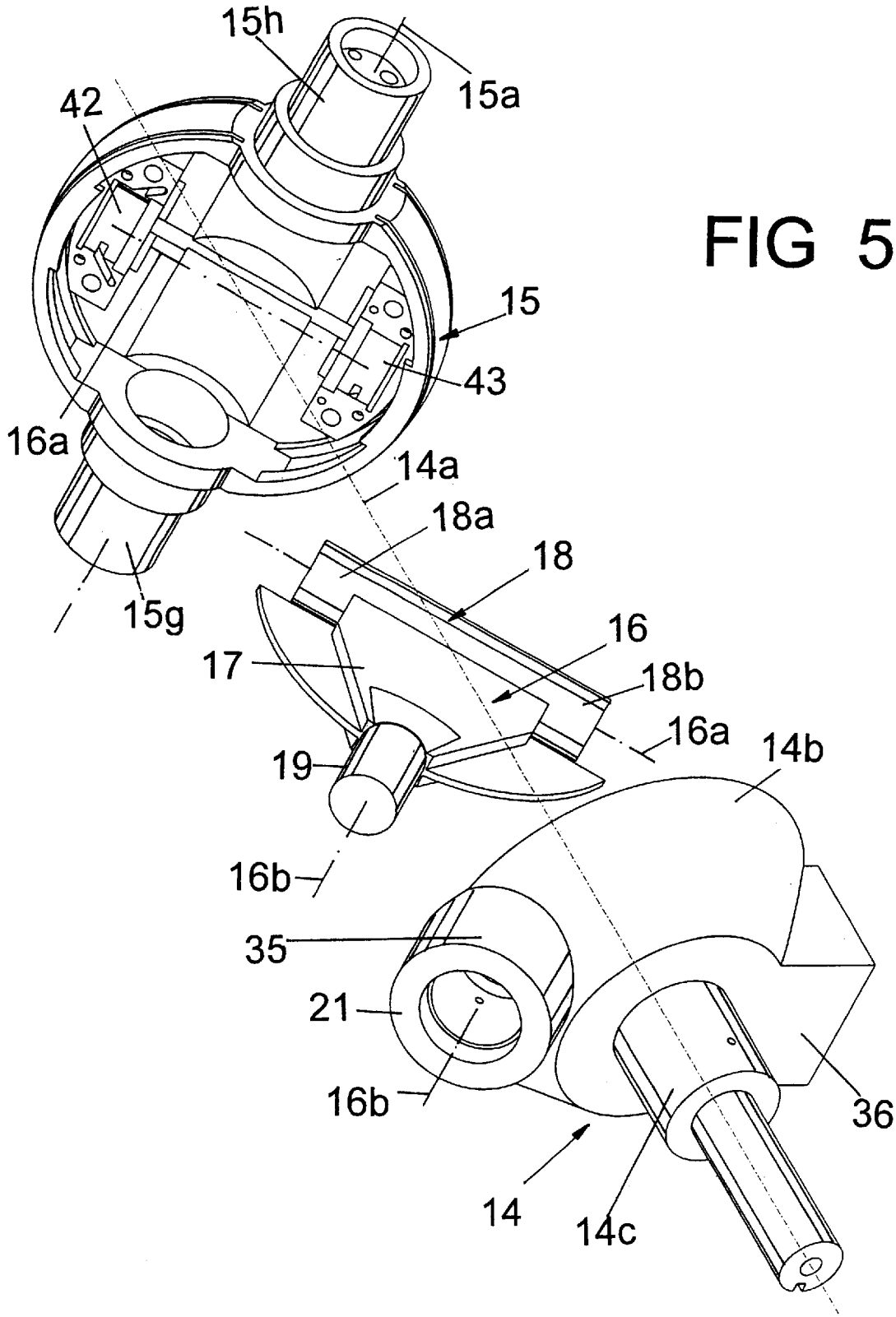
FIG. 5 shows in perspective three moveable components which form a part of the driving system according to FIG. 4*a* and which for the sake of clarity are illustrated in series along the rotational axis of the driving system, but otherwise shown separated individually.

The moveable components 14–16 comprise, as shown in FIG. 5, a main shaft 14, a piston construction 15 and a connecting means or driving means 16.

Figure 8:
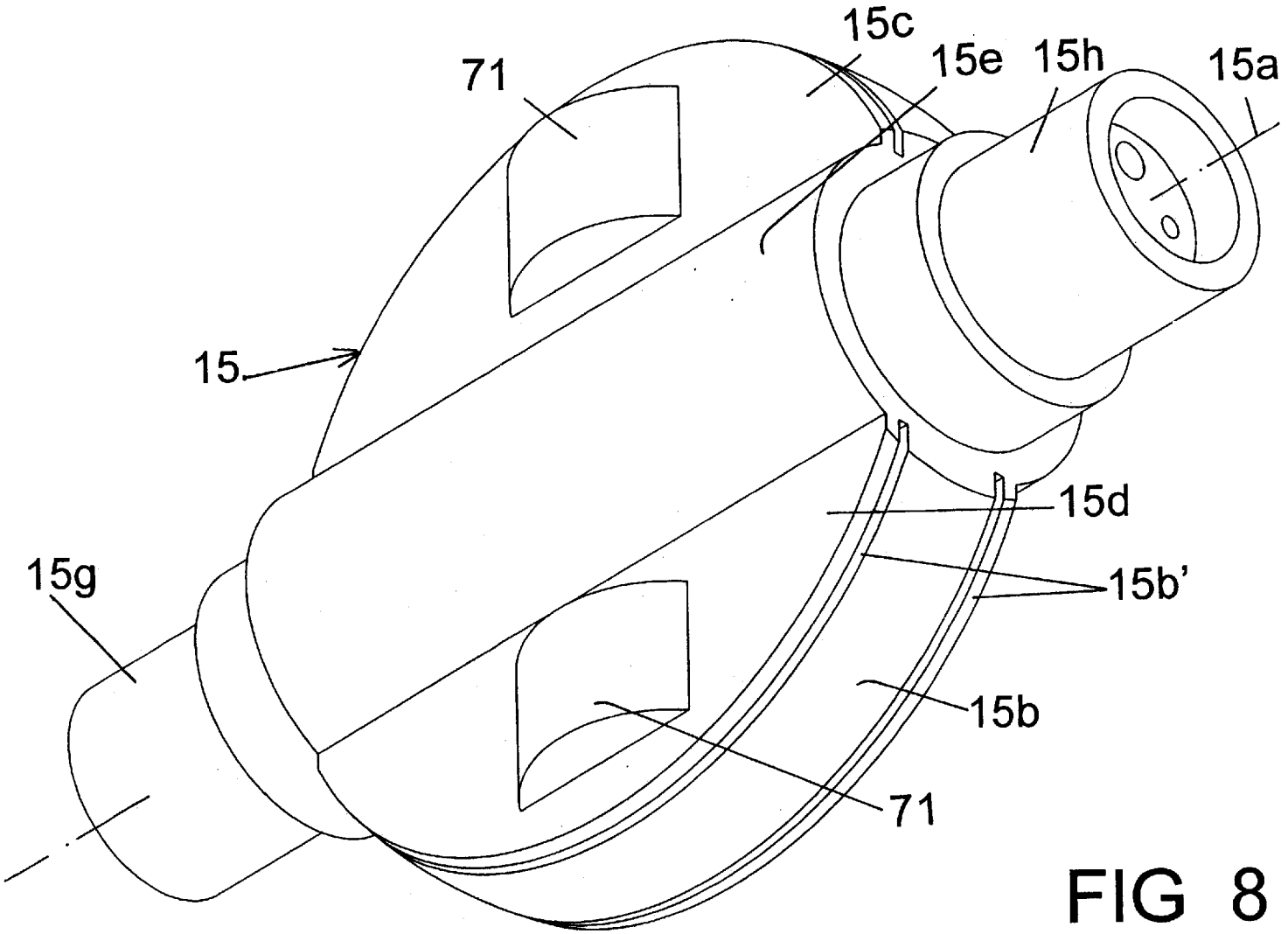
FIG. 8 shows in perspective a piston construction which constitutes a first moveable component of the driving system.

The piston construction 15 comprises, as is shown in FIG. 8, two oppositely disposed, mutually rigidly connected pistons 15*b* and 15*c*, which constitute the main pistons of the driving system.

The driving means 16 connects the main shaft 14 to the piston construction 15 and ensures the power transmission between these components 14,15. The driving means 16 has, according to the illustrated embodiment, a specific additional function, as will be evident from what follows, and will in this connection be designated as an auxiliary piston.

The hollow space 11 in the engine housing 10 is generally divided into two part-spherical hollow space section 11*a* and 11*b*, (see FIGS. 4 and 6) which in turn are divided into two first; work chambers 11*a*',11*a*" (see FIG. 6) and into two second work chambers 11*b*',11*b*" (see FIG. 4). The first work chambers are designated in the following as combustion chambers 11*a*',11*a*", while the second work chambers are designated in the following as auxiliary chambers 11*b*',1*b*".

The motor housing 10 comprises a first, outer, stationary housing component 10*a* (see FIGS. 4, 4*a* and 6) and a second, middle, stationary housing component 10*b* (see FIGS. 4 and 7) plus a rotatable, outer housing member 14*b* (see FIGS. 4 and 4*a*), which jointly define said spherical hollow space 11.

The two stationary housing components 10*a* and 10*b* (see FIGS. 6 and 7) enclose jointly the portions of the hollow space 11 which constitute the hollow space section 11*a*, that is to say the combustion chambers 11*a*',11*a*" of the engine, which are arranged on the one side of the piston construction 15.

The piston construction 15 (see FIG. 8), which constitutes the one moveable component of the driving system 13, is rockably mounted for rocking backwards and forwards in a rectilinear movement in the hollow space 11 about an associated stationary rocking axis 15*a* (see FIGS. 5 and 8). The combustion chambers 11*a*',11*a*" are mutually separated by means of the stationary, partition wall-forming ball segment portion 12 and are separated from the auxiliary chambers 11*b*',11*b*" by means of the piston construction 15. The combustion chambers 11*a*',11*a*" are consequently defined in the stationary housing components 10*a*,10*b* of the motor housing 10 by means of a stationary partition wall in the form of the stationary ball segment portion 12 and the rockable piston construction 15, so that the combustion process does not need to be effected by the rotating, outer housing member 14*b* of the engine housing. The driving force from the combustion process in the work chambers 11*a*',11*a*" sets the piston 15 into a precisely, rectilinear rocking movement backwards and forwards in the hollow space section 11*a* in a plane of movement which extends at right angles to the partition wall—forming ball segment portion 12.

Correspondingly the rotatable housing member 14*b* encloses a certain portion and the stationary, middle housing component 10*b* a remaining portion of the hollow space section 11*b*. These portions of the hollow space section 11*b* comprise the said auxiliary chambers 11*b*',11*b*", which are arranged on the other side of the piston construction 15 and which are mutually separated by means of the auxiliary piston 16.

The auxiliary chambers 11*b*',11*b*" are consequently defined in part in a rotatable housing member 14*b* and in part in a stationary housing component 10*b* of the engine housing 10, without this having undesirable effects on the medium which is handled in the auxiliary chambers 11*b*',11*b*" via the auxiliary piston 16.

The main shaft 14 of the driving system 13 includes as mentioned the rotating housing member 14*b*. The main shaft 14 and the housing member 14*b* consequently form a part of one and the same rotatable construction part and jointly constitute a driven part of the driving system 13 in the illustrated embodiment. The driving means 16, which is arranged in the hollow space 11*b* on the back side of the piston construction 15, constitutes first and foremost a connecting means between the main shaft 14 and the main piston 15, but, as mentioned, constitutes in addition an auxiliary piston which functions in the hollow space section 11*b*.

The main shaft 14 has a rotary axis 14*a* (see FIGS. 4 and 5), which crosses the spherical hollow space 11 at its centre point 11*c*.

The piston construction 15, which is rockably mounted in stationary housing components 10*a*,10*b* of the engine housing 10, is rockable about a first rocking axis 15*a* (see FIGS. 4, 4*a* and 5), which crosses the rotary axis 14*a* at said centre point 11*c* and which passes through the hollow space 11 at an angle of 90° relative to the rotary axis 14*a*.

The driving means/auxiliary piston 16 is rockable at its one end about a second rocking axis 16*a* (see FIG. 5), which crosses the rocking axis 15*a* at an angle of 90° in the main plane of the piston construction 15. The driving means/auxiliary piston 16 is pivotable at its other end relative to the main shaft 14 about a pivotal axis 16*b* (see FIGS. 4 and 5), which crosses the axes 14*a*,15*a*,16*a* at the centre point 11*c*. The pivotal axis 16*b* forms an angle of 45° with the rotary axis 14*a* and an angle of 90° with the rocking axis 16*a* of the driving means/auxiliary piston 16.

The common crossing point at the centre 11*c* is essential and preferred for functional reasons and the said crossing angles of 45° and 90° are preferred angles practically. However the said axial courses, and especially the axial course of the pivotal axis 16*b*, can in practice deviate from the indicated crossing angles, according to need.

The piston construction 15 is shown having disc sector-shaped pistons 15*c* and 15*d*, each with spherical outer peripheral surface 15*b*, which is adapted according to the spherical inner surface 11*d* (see FIG. 6) of the hollow space 11. In the surfaces 15*b* (see FIG. 8) there are inserted sealing strips 15*b*', which form slide seals against the inner surface 11*d* of the spherical hollow space 11.

Figure 6:
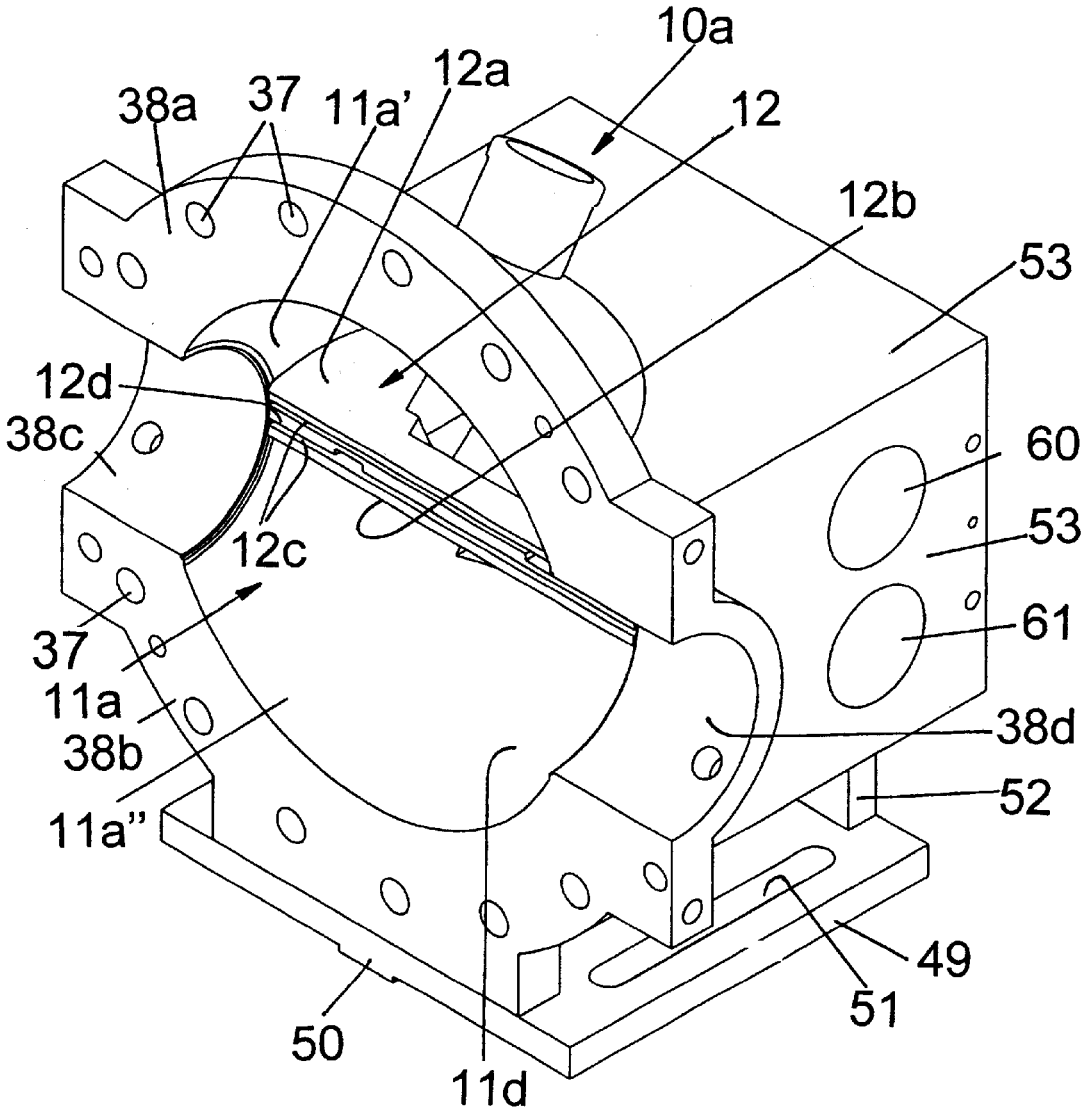
FIGS. 6 and 7 show in perspective a first and a second stationary housing component, which forms a part of the driving system.

The pistons 15*c* and 15*d* have, as shown in FIG. 8, that is to say on the side which faces towards the combustion chambers 11*a*',11*a*" a substantially flat main surface of each of two mutually opposite, disc sector-formed piston portions, which are called herein the pistons 15*c* and 15*d*. The main surface of the one piston 15*c* cooperates with a first side surface 12*a* of the partition wall, that is to say of the stationary housing portion 12, while the main surface of the remaining piston 15*d* cooperates with an equivalent second side surface 12*b* of the housing portion 12, as is shown in FIG. 6. Between the pistons 15*c*,15*d* a transition portion is present in the form of a part-circular hub portion 15*e*, which forms a sliding abutment against sealing strips 12*c* in the radially innermost edge surface 12*d* (see FIG. 6) of the housing portion 12.

Auxiliary Piston 16 of the Driving System 13

Figure 9:
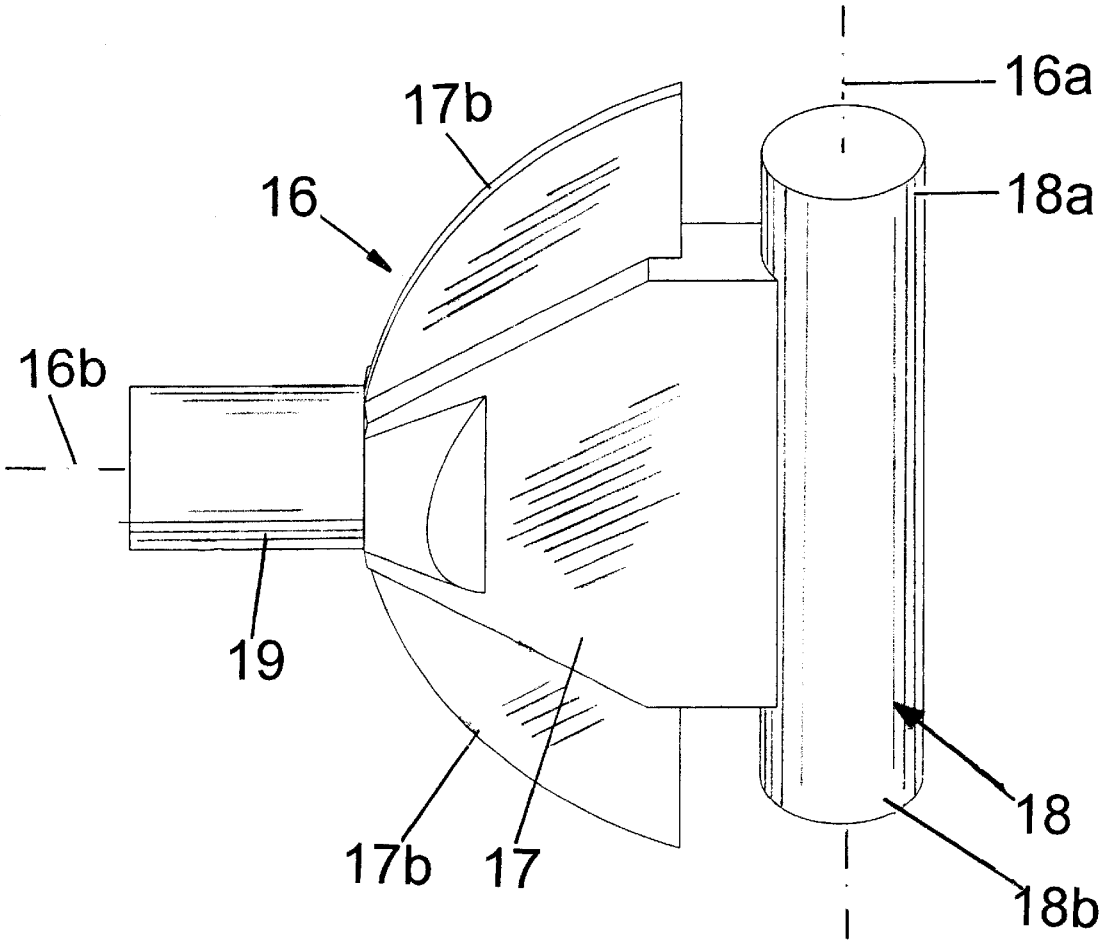
FIG. 9 shows in perspective a driving means which constitutes a second moveable component of the driving system.

As is shown in FIG. 4 and 9 the auxiliary piston 16 comprises a disc-shaped plate 17, which according to the illustrated embodiment spans across the hollow space section 11*b* and divides this into two auxiliary chambers 11*b*',11*b*".

In the illustrated embodiment, that is to say in connection with a two-stroke combustion engine, the auxiliary piston 16 has an essential, functional significance, since the auxiliary piston 16 can ensure a dose correct feeding in of fuel mixture from a respective auxiliary chamber 11*b*',11*b*" of the hollow space section 11*b* to an associated combustion chamber 11*a*' and 11*a*" respectively of the hollow space section 11*a*. Simultaneously with the controlled dose feeding in of the fuel mixture into the combustion chambers 11*a*',11*a*" the auxiliary piston 16 can together with the rotating member 14*b* of the engine housing 10 provide for an extra mixing together of the fuel mixture in the auxiliary chambers 11*b*',11*b*". In addition the auxiliary piston can ensure an extra compression of the fuel mixture before it is fed into the combustion chambers 11*a*',11*a*".

The said two auxiliary chambers 11*b*' and 11*b*" can individually cooperate with their respective combustion chambers 11*a*' and 11*a*" of the housing space section 11*a* via their respective flow ducts 20*a*,20*b* (see FIG. 7) which are formed in the material of the middle, stationary housing component 10*d*. The associated port openings of the ducts 20*a*,20*b* are covered/uncovered partly by means of the corresponding rocking motion of the piston construction 15 relative to the stationary, middle housing component 10*b*, and partly by means of the equivalent pivotal and rocking motion of the auxiliary piston 16 relative to the said middle housing component 10*b*.

However according to the invention it is not an absolute requirement that the driving means 16 shall serve as a piston in the associated hollow space section 11*b*. Alternatively the driving means 16 can serve only as a connecting means between the piston construction 15 and the main shaft 14, for example in connection with a four-stroke combustion engine, where the feeding in of fuel can occur in an arbitrary manner not shown further, for example by direct fuel injection into the associated combustion chambers 11*a*,11*a*'.

The auxiliary piston 16 (see FIG. 9) comprises a plate 17, which at the one, straight end edge is rigidly connected to a longitudinal shaft pin 18, the longitudinal axis of which constitutes one rocking axis 16*a* of the driving means 16. The shaft pin 18 has opposite ends rockably mounted directly in the piston construction 15 on its rear side, that is to say on the side which faces towards the hollow space portion 11*b*. The shaft pin 18 is fixed to the main piston 15 via bearing-forming fastening members 18*a*.

At the opposite, circular arc-formed end edge 17*b*, which is adapted in accordance with the inner surface 11*d* of the hollow space 11, the plate 17 is provided with a guide pin 19, which projects radially outwards relative to the hollow space 11 along a longitudinal axis, which constitutes the remaining pivotal axis 16*b* of the driving means 16. The guide pin 19 is pivotally mounted in a pivotal bearing 21 (see FIG. 5) in the rotatable housing component of the rotor member 14, which constitutes a head portion 14*b* projecting freely outwards from the rotor.

Mode of Operation of the Driving Means 16

On each rocking of the piston construction 15 in the illustrated two-stroke combustion engine 10 the shaft pin is subjected to an equivalent rocking motion. The shaft pin 18 and the control pin 19 are consequently driven by the movements of the piston construction 15 and hereby are adapted to rock/pivot each about its axis 16*a*,16*b* at the same time as the guide pin 19 sets the main shaft 14 in a rotational movement about its own longitudinal axis 14*a*.

By means of the fuel combustion~ which takes place alternately in the combustion chambers 11*a*',11*a*", the piston construction 15 is subjected to a backwards and forwards rocking motion about the rocking axis 15*a*. This involves the one end of the driving means 16 being forcibly subjected via its shaft pin 18 to an equivalent rocking motion.

By the fact that the other end of the driving means 16 is pivotally mounted via the control pin 19 in the main shaft 14 in its peripheral portion of the housing component 10*c* about the pivotal axis 16*b*, a controlled rocking motion is ensured of one end of the driving means via the shaft pin 18 relative to the main piston 15 and simultaneously a controlled circular motion of the guide pin 19 of the driving means 16 relative to the main shaft 14. Consequently the main shaft 14 is subjected to a forced rotational motion following from this, which is produced by a corresponding torque arm between the rotational axis 14*a* and the pivotal axis 16*b* of the driving means 16.

In other words with the driving system 13 according to the invention an effective transfer of driving force can be ensured from the backwards and forwards rocking piston construction 15 via the backwards and forwards pivoting driving means 16 to the rotating main shaft 14.

Figures 5A, 5B, 5C, 5D:
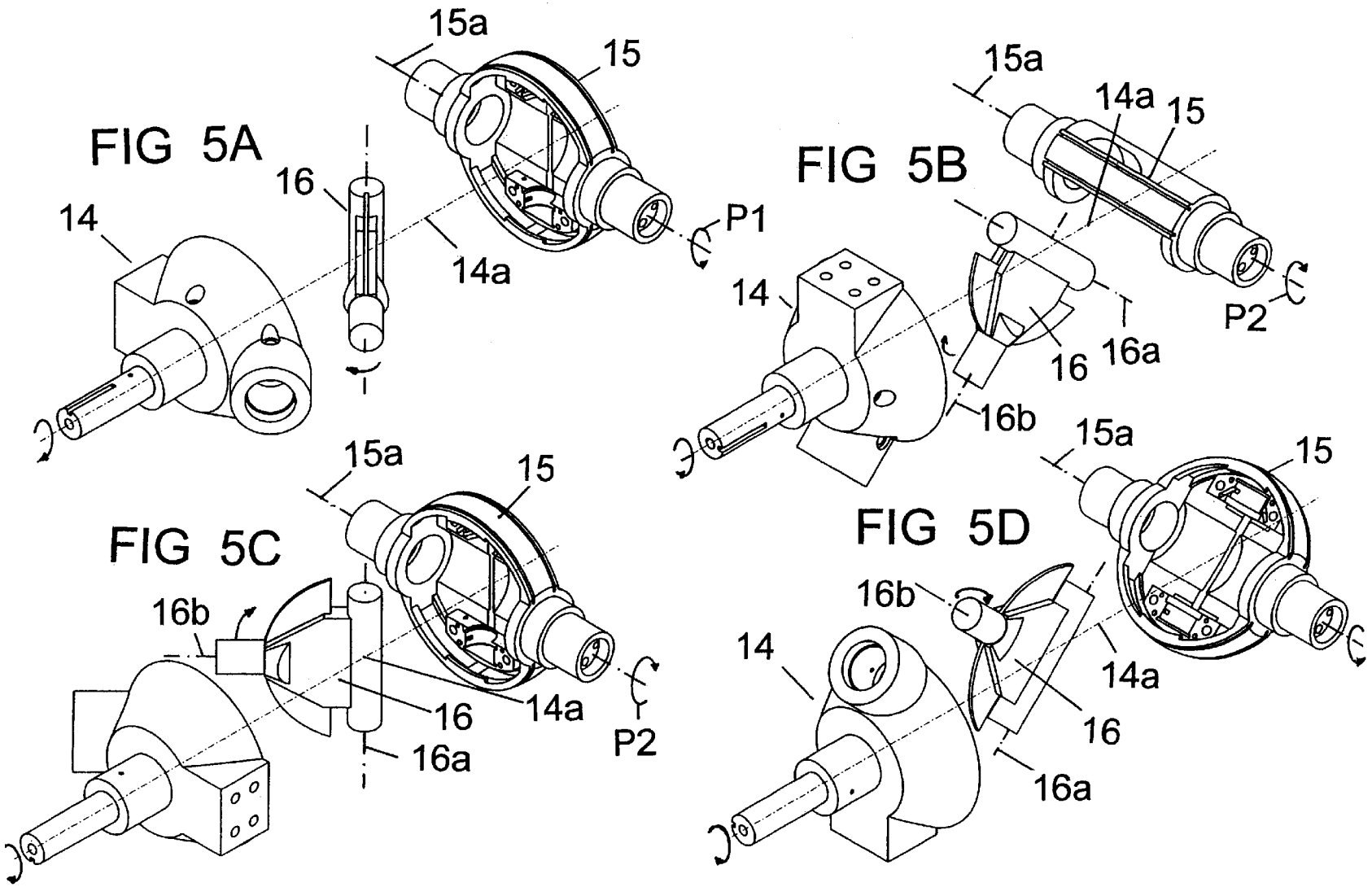
FIGS. 5*a*–5*d* show the three moveable components according to FIG. 5 in corresponding disposition, but with the components illustrated in different relative positions about the rotational axis of the driving system.

In FIG. 5*a* there are illustrated the three moveable components 14–16 in a position corresponding to a 0° (360°) position, with the piston construction 15 arranged vertically and the associated shaft pin 18 of the auxiliary piston 16 arranged correspondingly vertically.

In FIG. 5*b* the piston is tilted out 45° to the side, as shown by the arrow p1, from the position as shown in FIG. 5*a*. The shaft pin 18 of the auxiliary piston 16 is shown equivalently tilted. This means that the pivot pin 19 of the auxiliary piston 16 is forcibly swung about a circular arc of 90°, as shown by the arrow p2, together with main shaft 14.

In FIG. 5*c* the piston construction 15 and the shaft pin 18 are shown pivoted back 450 to the vertical starting position in the arrow direction p2, while the pivot pin 19 of the auxiliary piston 16 and the main shaft 14 are pivoted further an additional circular arc of 90°.

In FIG. 5*d* the piston construction 15 and the shaft pin 18 are shown pivoted obliquely outwards 45° to the opposite side relative to that which is shown in FIG. 5*b*, while pivot pin 19 of the auxiliary piston 16 and the main shaft 14 are pivoted additionally further a circular arc of 90°.

Thereafter the piston construction 15 is tilted back in the direction of the arrow p1 and the auxiliary piston 16 is pivoted back to the starting position as shown in FIG. 5*a*, while the main shaft 14 has made collectively a rotational movement of 360°, after which the afore-mentioned cycle is continued in the afore-mentioned manner.

In the illustrated embodiment, where the driving system 13 is employed in a combustion engine, the motive power is transferred from the piston construction 15 via the driving means 16 to the main shaft 14.

In other cases not shown further, for example in connection with a compressor or pump, the motive power can be transferred in the opposite direction, that is to say from the main shaft 14 via the driving means 16 to the piston construction 15.

The Engine According to the First Embodiment

In the following, specific details of the engine per se shall be described according to the illustrated embodiment according to FIGS. 1–4 and 4*a*.

The engine comprises a support plate 22 having a longitudinal guide track 23 for guiding the various engine components into correct positions relative to each other. The support plate 22 is provided with associated screw holes for securing the components to the support plate 22.

Operational Outlet end of the Engine

Main shaft 14 of the engine has, as mentioned and as illustrated in FIG. 4*a*, a freely outwardly projecting head portion 14*b* having a radially greatest dimension. The head portion 14*b* defines internally (see FIG. 4) a certain portion of the space section 11*b* and is in addition provided with the bearing 21 (FIG. 5) for the guide pin 19 of the driving means 16.

The main shaft 14 is further provided with a middle hub portion 14*c* (FIG. 4*a*), which is rotatably mounted directly in the one end of a stationary bearing member 24 (see FIG. 4). The hub portion 14*c* has a midmost radial dimension.

At the other end of the main shaft 14 there is designed a stem portion 14*a* (FIG. 4*a*), which has a smallest radial dimension. The stem portion 14*c* is partly mounted directly in the bearing member 24 and partly mounted in the bearing member 24 via a sleeve portion 25 of a belt disc 26. The belt disc 26 (which has a driving belt not shown further) is drive connected to the main shaft 14 via a key (not shown further) and an associated key way 27 (FIG. 4*a*) plus a fastening screw 28 (FIG. 4) received in a screw-threaded end bore 29 in the associated end portion 14*e* of the main shaft 14.

Bracket 24*a* (FIG. 2) of the bearing member 24 is provided with a longitudinal guide groove 30, which is passed through by fastening bolts 31 (FIG. 4), with which the bearing member 24 is fixed to the support plate 22. A centering member in form of a protrusion (see the protrusion 50 for the housing component 10*a* in FIG. 6) on the under side of the bearing member 24 guides the bearing member 24 axially along the support plate 22 in the guide groove 23.

On the opposite side of the belt disc 26 a support member 32 is arranged for an electrical distributor (not shown further) of the engine which is driven directly from the main shaft 14. The support member 32 is fixed via a bracket 32*a* to the support plate 22 in a corresponding manner to the bearing member 24.

A shroud 33 (see FIGS. 1 and 4), which radially encloses head portion 14*b* of the main shaft 14, is fastened by means of screws to the peripheral portion of the stationary bearing member 24 and via sealing means is supported against the peripheral portion of the stationary bearing member 24 at the end which faces towards the engine housing 10. The shroud 33 converges from the bearing member 24 outwards towards a radial outer portion 34 of the stationary housing component 10*b* of the engine housing 10, where the shroud 33 is fastened with screws to the housing component 10*b* and via sealing means is supported against the housing component 10*b*. By means of the shroud 33 there is defined an outwardly sealed-off, stationary sealing chamber 33*a*, which encloses the co-rotating head portion 14*b* of the rotatable main shaft 14. By means of the shroud 33 fuel, which is fed into the auxiliary chambers 11*b*',11*b*", can be prevented from leaking out of the engine at the rotating head portion 14*b* of the main shaft 14.

The head portion 14*b* (see FIG. 4*a*) is shown with thickened protrusion 35, in which there is fashioned the pivot bearing 21 for guide pin 19 of the driving means/auxiliary piston 16. At the opposite side the head portion 14*b* is provided with a second, thickened protrusion 36, which can counterbalance the rotational forces which are produced in the head portion 14*b*.

Figure 7:
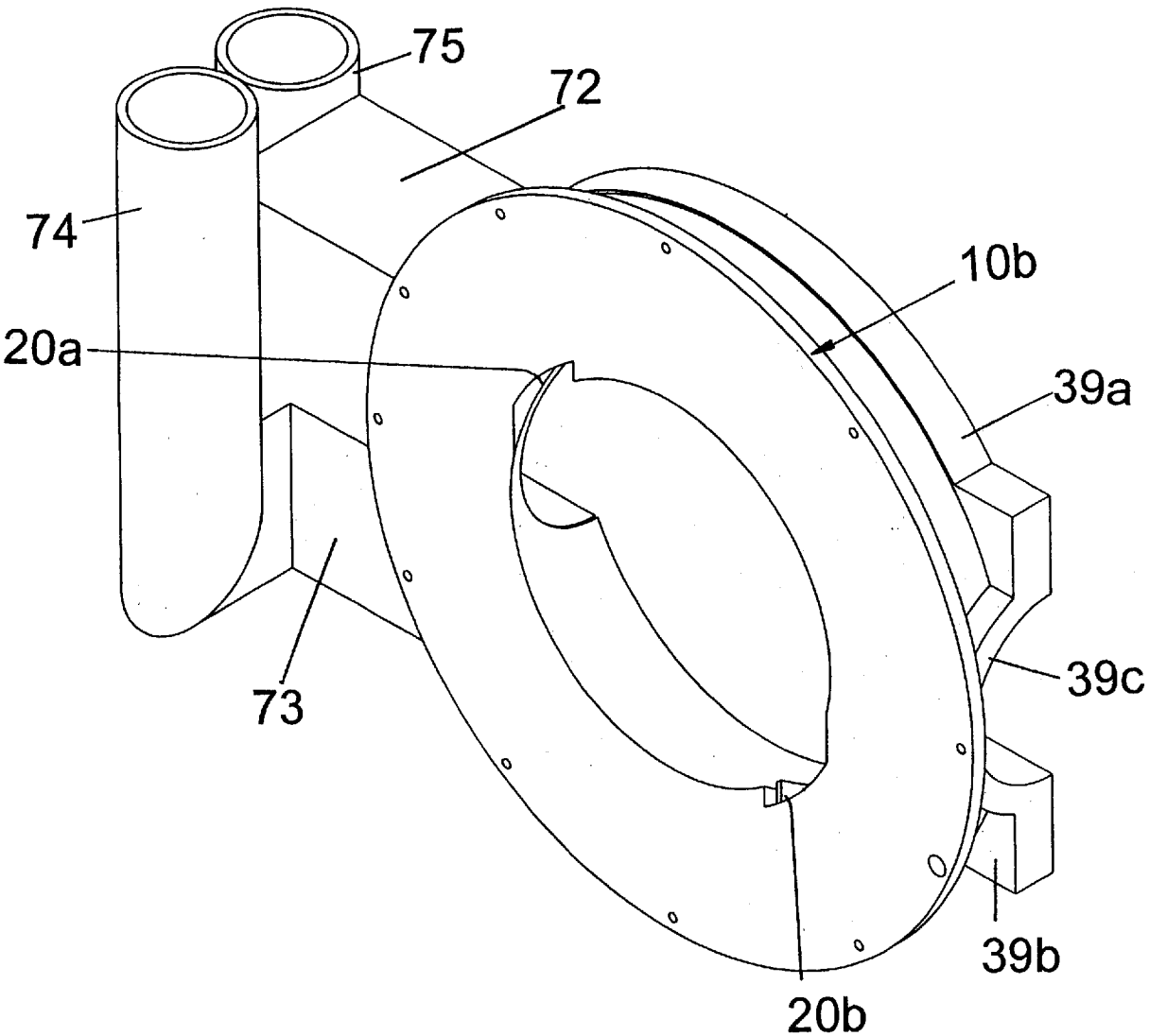

The Assembling Together of the Housing Components 10*a*,10*b* of the Engine The stationary housing components 10*a* and 10*b* of the engine housing 10 thrust together along a vertical plane, which passes through the rocking axis 15*a* of the piston construction 15. The stationary housing members 10*a*,10*b* are assembled together by means of fastening bolts (not shown further) which pass through the bores 37 in equivalent respective flanges 38*a*,38*b* and 39*a*,39*b* of the housing components 10*a*,10*b* as shown in FIGS. 6 and 7. The housing components 10*a*,10*b* are shown each with their semi-circular, bearing-forming recesses 38*c*,38*d* and 39*c*, in which associated end pins 15*g*,15*h* of the piston construction 15 are rockably mounted via intermediate bushings 40,41 (FIG. 4).

Immediately the piston construction 15 is fastened in place between the housing components 10*a*,10*b* in the recesses 38*c*,38*d*,39*c*, the piston 15 is simultaneously shut off in a controlled sliding engagement between them, independently of the rotating engine housing member 14*b*.

Two end pins 18*a*,18*b* of the shaft pin 18 of the driving means/auxiliary piston 16 are arranged in two mutually opposite, semi-circular, bearing-forming recesses 42,43 (see FIG. 5) in the rear side portion of the piston construction 15 and are shut off by means of two fastening members 18*c* (see FIG. 4) with equivalent semi-circular, bearing-forming recesses.

As shown in FIG. 4 the shaft pin 18 forms a sliding abutment against a stationary, middle flange-formed partition wall 48, which projects freely outwards from the piston construction 15 on its rear side (see FIG. 4) The flange 48 divides together with the auxiliary piston 16, as is shown in FIG. 4, the second hollow space section 11*b* of the hollow space 11 into two auxiliary chambers 11*b*',11*b*".

The Housing Component 10*a*

The housing component 10*a* is centered in place on the support plate 22 via a bottom plate 49 (FIG. 2), having an axial longitudinal protrusion 50, which projects downwardly from the under side of the bottom plate 49 in engagement with the guide groove 23 in the support plate 22. The bottom plate 49 is further provided with longitudinal slots 51 for fastening bolts (not shown), which pass through the bottom plate 49 and fasten the latter via bores in the support plate 22.

From one end of the bottom plate 49 (FIG. 6),there projects vertically upwards the flange portion 38. From the other end of the bottom plate 49 there projects upwardly a support bracket 52. The flange portion 38 and the bracket 52 support their respective ends of an intermediate housing portion 53, which is arranged at a certain distance from the bottom plate 49.

In the rear end of the housing portion 53 there is arranged an exhaust outlet 53*a* from an exhaust duct 53*b* to the exhaust manifold (not shown further) of the engine.

Figure 10:
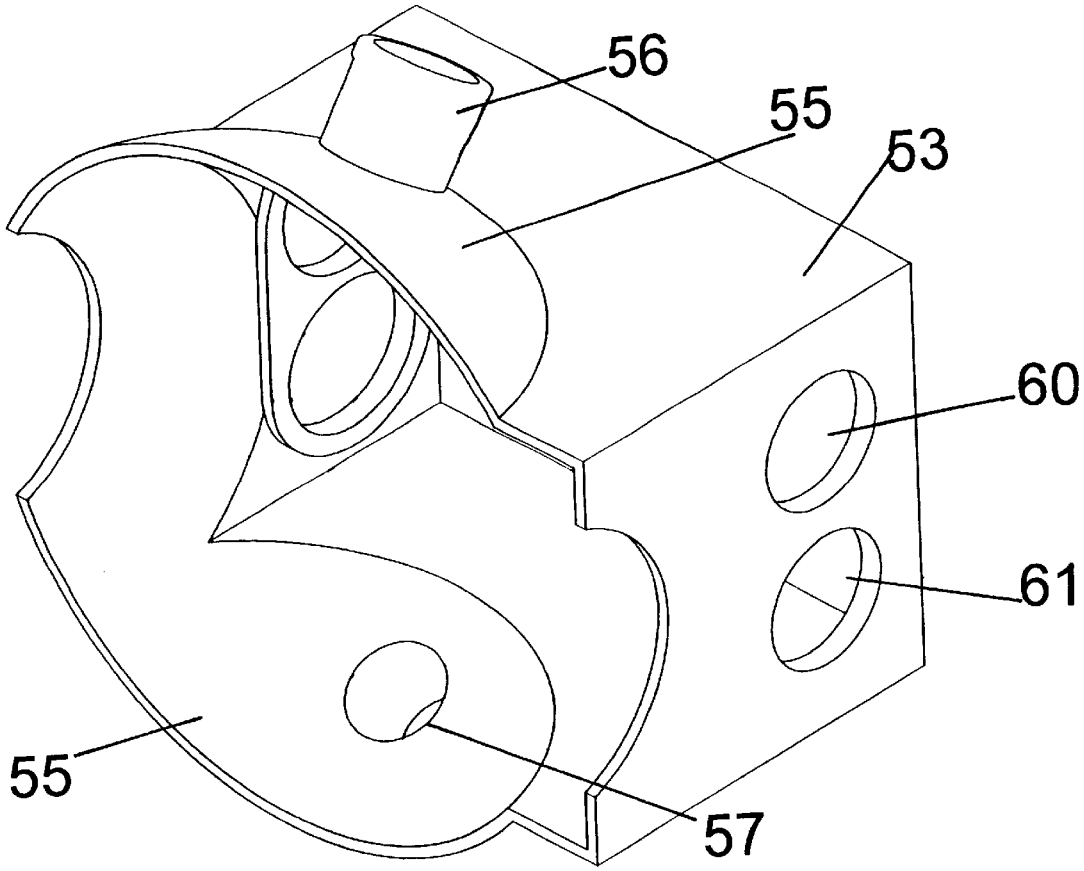
FIGS. 10 and 11 show in perspective and in front view respectively a water jacket-forming case for parts of the housing component as shown in FIG. 6.
Figure 11:
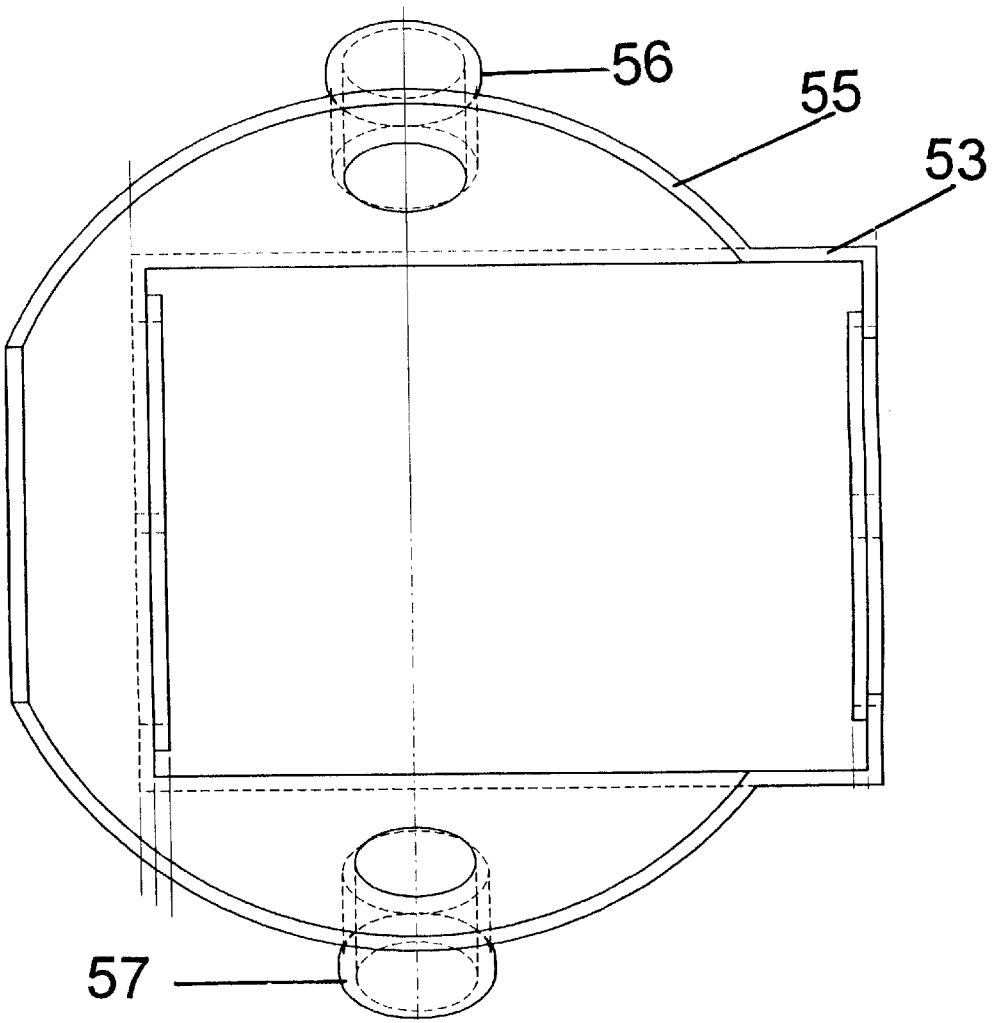

The housing portion 53 comprises an outer water jacket portion 55 (see FIGS. 10 and 11), which encloses the housing portion in the region before the exhaust duct 53*b*. The water jacket portion 55 is provided with an upper cooling water inlet 56 at the top of the engine and a lower cooling water outlet 56 arranged just above the bottom plate 49. A cooling water chamber 57 is defined between the outer water jacket portion 55 and a block portion 58 lying within, for circulating cooling water through essential portions of the stationary housing component iOa of the engine.

Block Portion 58 of the Housing Component 10*a*

The block portion 58 (see FIG. 12) includes the ball sector-formed/orange boat-formed, stationary housing portion 12 and adjacent spherical wall portions 11*d* of the combustion chambers 11*a*',11*a*".

Figure 12:
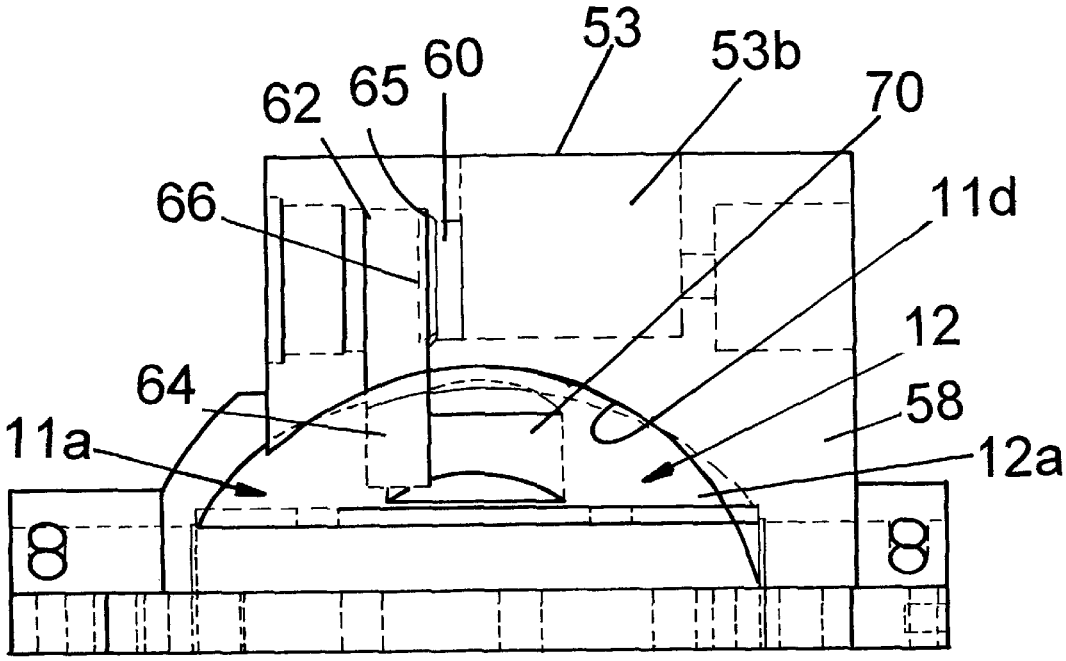
FIG. 12 shows a side view of the housing component according to FIG. 6.

In the block portion 58 there is further formed a transverse upper bore 60 and a corresponding, transverse lower bore 61 (see FIG. 6). Each of the bores 60,61 is connected at its one end to its respective ignition chamber 62 (FIG. 12). Each ignition chamber 62 includes a spark plug 63 (see FIG. 13) and is arranged via a connecting duct 64 in open connection with its respective associated combustion chamber 11*a*', 11*a*".

Figure 13:
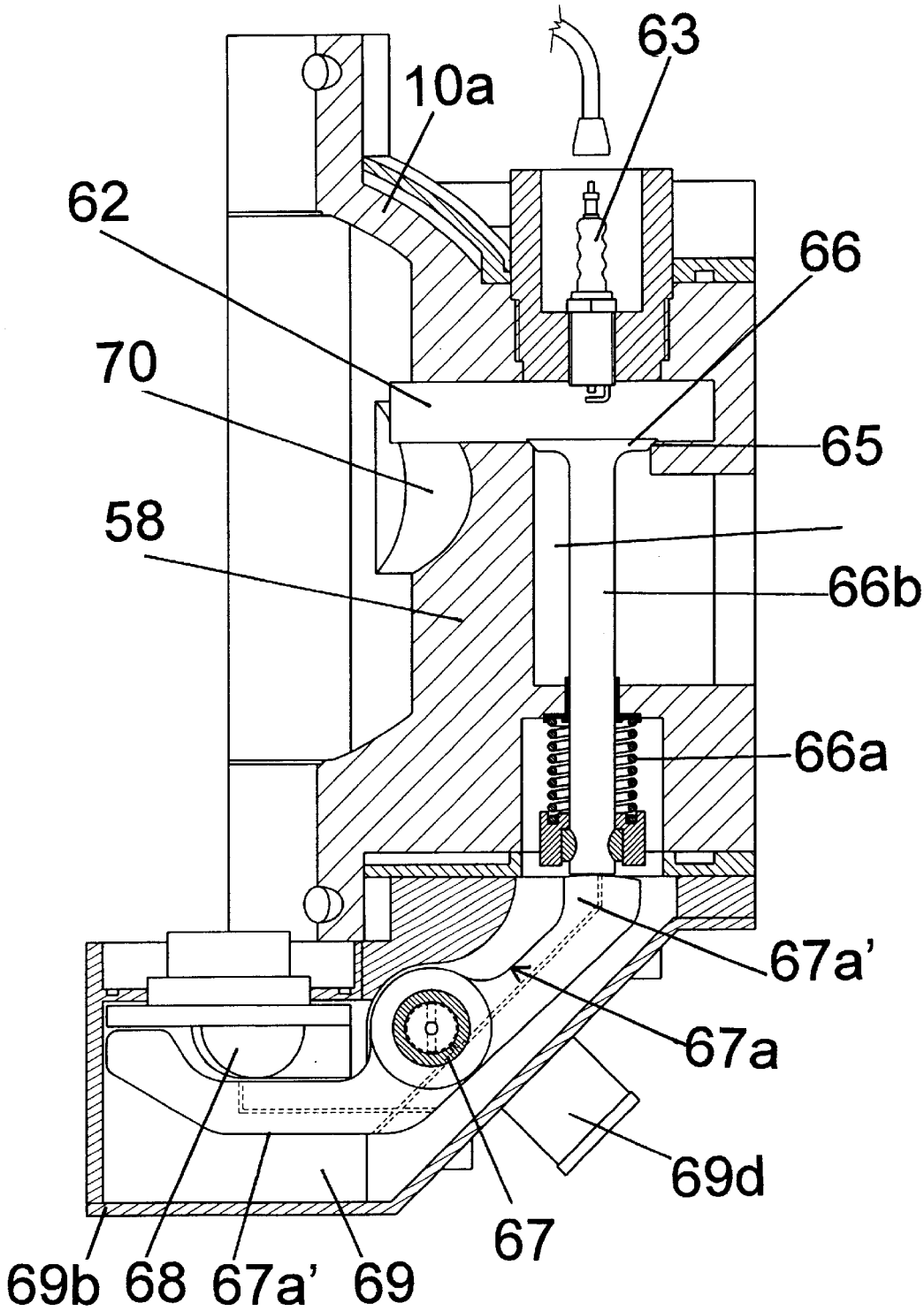
FIG. 13 shows in section a segment of an exhaust valve.

The ignition chamber 62 is defined in each bore 60,61 from an associated common exhaust outlet 53*a* via a valve seat 65 having an associated valve member 66 (see FIG. 13). The valves 66 operate in a corresponding manner each in its work cycle. Each valve 66 is closed by an associated compression spring 66*a* and is opened by actuation of an associated valve spindle 66*b* by means of the one branch 67*a*' of rocking arm 67*a*.

The rocking arm 67*a*, is swung about a common pivot shaft 67 and is actuated via another respective branch 67*a*" of a common cam shaft, 68 (see FIG. 14), which is fixedly connected to the one pivot pin 40 of the main piston 15.

Figure 14:
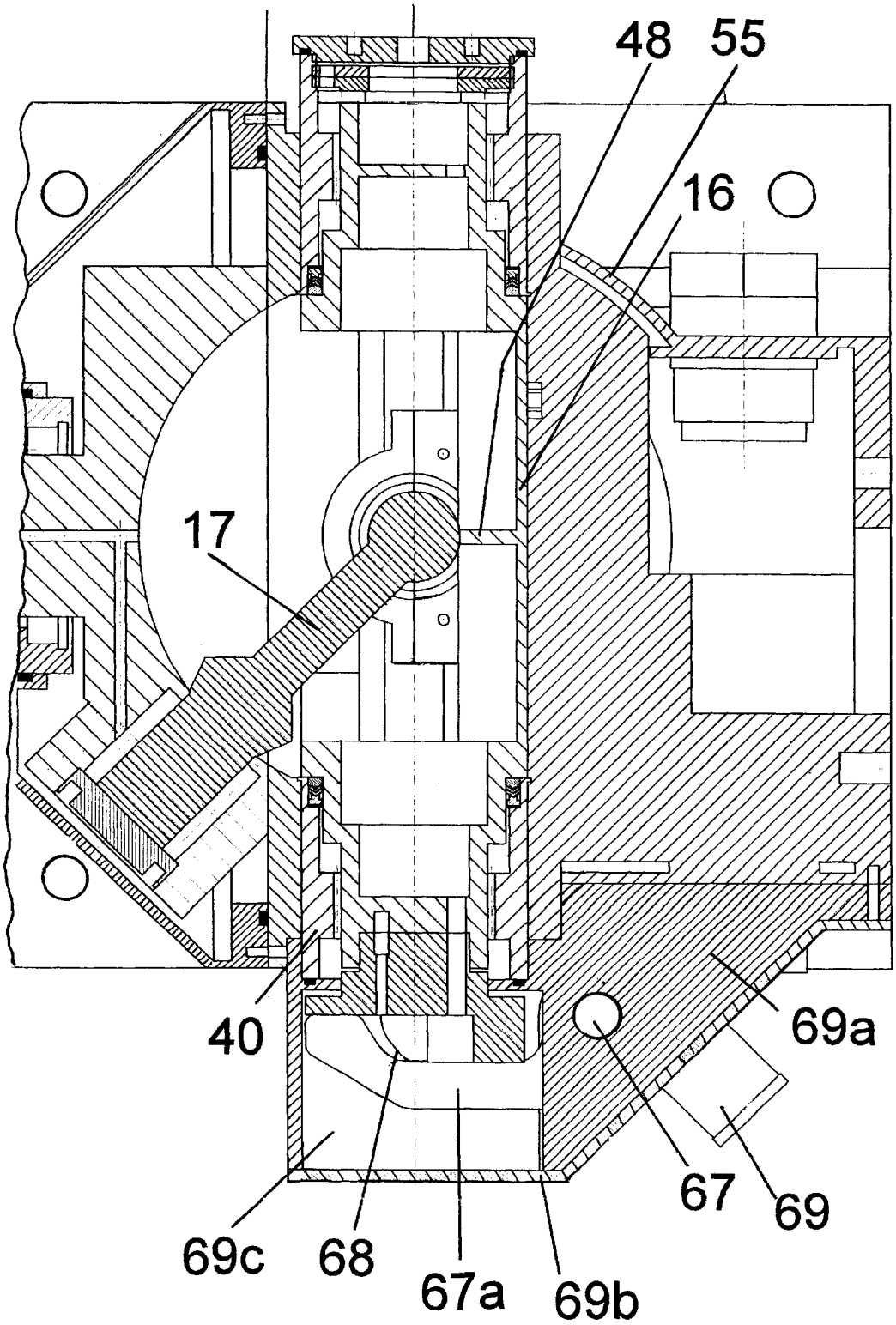
FIG. 14 shows a segment of FIG. 4.

In FIG. 14 there is shown a housing member 69*a*, in which there is arranged the pivot shaft 67 and parts of the rocking arms 67*a*, 67*b*, and by means of a cover member 69*b* an oil chamber 69*c* is defined. At 69*d* there is shown an inlet for the supply of lubricating oil to the chamber 69.

As shown in FIG. 12, the bore 61 has a sideways directed duct 64 from the ignition chamber 62 to a concavely curved countersink 70 in main surfaces 12*a*,12*b* of the housing component portion 12. Pistons 15*c*,15*d* of the piston construction 15 are provided on associated piston surfaces with equivalent, convexly curved protrusions 71 (see FIG. 8) which in corresponding outer positions of the pistons are adapted to be received in and fill an associated countersink 70 in the equivalent main surface 12*a*,12*b* of the housing component portion 12.

The Housing Component 10*b*

The housing component 10*b* (see FIG. 7) is shown with an upper flushing chamber 72 and a lower flushing chamber 73 which are connected to their respective supply pipes 74,75. The supply pipes 74,75 feed individually to an associated flushing chamber 72,73 a mixture of fuel (for example petrol) and air from a carburetor not shown further. In the upper flushing chamber 72 the fuel mixture is led a relatively short path to the associated auxiliary chamber 11*b*' via the duct 20*a* and in the lower flushing chamber 72 the fuel mixture is led a relatively longer path to the associated auxiliary chamber 11*b*" via the duct 20*b*. The port openings of the ducts 20*a*,20*b* are covered and uncovered in part by means of the piston construction 15 and in part by means of the auxiliary piston 16.

What is claimed is:

1. A Driving system (13) comprising a housing (10) having a spherical hollow space (11), a rotatable main shaft (14), a driving means (16) drivingly connected to the main shaft (14) and a piston construction (15) connected to the driving means (16), where the piston construction (15) is rockable backwards and forwards in the hollow space (11) relative to a stationary wall portion (12) in the hollow space (11) and where one end of the driving means (16), which participates in the rotational motion of the main shaft (14) is pivotally mounted in the main shaft (14) about a pivotal axis (16*b*) which forms an acute angle with the rotational axis (14*a*) of the main shaft (14), characterized in that the piston construction (15), which comprises a pair of mutually rigidly connected pistons (15*c*,15*d*), is rockable relative to the surrounding housing (10)about a first rocking axis (15*a*), which centrally passes through the spherical hollow space (11) at right angles to the rotational axis (14*a*) of the main shaft (14), that the piston construction (15) is rockable towards and from an intermediate, stationary wall portion (12), which projects radially inwards into a first hollow space section (11*a*) of the spherical hollow space (11) and divides the hollow space section (11*a*) into two opposite work chambers (11*a*' 11*a*"), that the other end of the driving means (16) is rockably mounted in the piston construction (15) about a second rocking axis (16*a*), which extends at right angles to the first rocking axis (15*a*), the first and second rocking axes (15*a*,16*a*) crossing the rotational axis (14*a*) of the main shaft (14) at a common crossing point (11*c*) centrally in the spherical hollow space (11).

2. The Driving system in accordance with claim 1, characterised in that the work chambers (11*a*',11*a*") of the first hollow space section (11*a*) are defined between the rockable piston construction (15) a pair of stationary housing components (10*a*,10*b*) and the stationary partition wall (12).

3. The Driving system in accordance with claim 1 characterised in that the pistons (15*c*,15*d*) of the piston construction (15) constitute main pistons of the driving system (13), which form a part of the first hollow space section (11*a*), and that the driving means (16) constitutes an auxiliary piston, which forms a part of the second hollow space section (11*b*), the driving means (16) being disc-shaped and dividing the second hollow space section (11*b*) into two associated auxiliary chambers (11*b*',11*b*").

4. The Driving system in accordance with claim 3, characterised in that the second hollow space section (11*b*) is mainly formed by a rotatable housing member (14*b*), which is directly connected to the main shaft (14), the rotatable housing member (14*b*) including a rotary bearing for the associated guide pin (19) of the driving means (16).

* * * * *